US006935977B2

(12) United States Patent
Kennedy, II et al.

(10) Patent No.: US 6,935,977 B2
(45) **Date of Patent: *Aug. 30, 2005**

(54) SPORT BALL WITH PUMP HAVING PRESSURE RELIEF AND/OR PRESSURE INDICATION CAPABILITY

(75) Inventors: Thomas J. Kennedy, II, Wilbraham, MA (US); Ronald P. LaLiberty, Dudley, MA (US); Matthew K. Lacroix, Grandby, MA (US); Kenneth V. Schomburg, Wayzata, MN (US)

(73) Assignee: Russell Asset Management, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/408,052

(22) Filed: Apr. 4, 2003

(65) Prior Publication Data

US 2004/0048705 A1 Mar. 11, 2004

Related U.S. Application Data

(63) Continuation-in-part of application No. 10/183,337, filed on Jun. 25, 2002, now Pat. No. 6,702,699, which is a continuation of application No. 09/594,980, filed on Jun. 15, 2000, now Pat. No. 6,409,618, which is a continuation-in-part of application No. 09/478,225, filed on Jan. 6, 2000, now Pat. No. 6,287,225.

(60) Provisional application No. 60/159,311, filed on Oct. 14, 1999, provisional application No. 60/435,225, filed on Dec. 20, 2002, and provisional application No. 60/404,889, filed on Aug. 21, 2002.

(51) Int. Cl.[7] ..... A63B 41/12

(52) U.S. Cl. ..... 473/593

(58) Field of Search ..... 473/593–595, 473/603–610; 446/220, 224; 417/478, 480, 499, 259; 36/29

(56) References Cited

U.S. PATENT DOCUMENTS

| | | | | | |
|---|---|---|---|---|---|
| 362,532 | A | | 5/1887 | Patterson | |
| 602,294 | A | * | 4/1898 | Arnold | 473/593 |
| 2,625,770 | A | | 1/1953 | Steen | |
| 2,698,028 | A | * | 12/1954 | Lee et al. | 446/224 |
| 2,737,969 | A | | 3/1956 | Iknayan | |
| 3,020,673 | A | | 6/1962 | Cook | |
| 3,119,617 | A | * | 1/1964 | Topper | 473/593 |
| 3,229,976 | A | | 1/1966 | Allen | |
| 3,230,968 | A | | 1/1966 | Struby | |
| 4,568,081 | A | | 2/1986 | Martin | |
| 4,595,200 | A | | 6/1986 | Shishido | |
| 4,776,589 | A | | 10/1988 | Yang | |
| 4,842,563 | A | | 6/1989 | Russell | |
| 4,856,781 | A | | 8/1989 | Shishido | |
| 4,862,533 | A | | 9/1989 | Adams, III | |
| 5,068,933 | A | | 12/1991 | Sexton | |
| 5,098,095 | A | * | 3/1992 | Weiss | 473/593 |
| 5,219,162 | A | | 6/1993 | Orbanes | |
| 5,238,244 | A | * | 8/1993 | Cotter et al. | 473/593 |
| 5,375,839 | A | | 12/1994 | Pagani | |
| 5,500,965 | A | | 3/1996 | Hannagan | |
| 5,603,131 | A | | 2/1997 | DeJean, Jr. | |
| 5,755,634 | A | * | 5/1998 | Huang | 473/570 |
| 6,287,225 | B1 | * | 9/2001 | Touhey et al. | 473/593 |
| 6,409,618 | B1 | * | 6/2002 | Touhey et al. | 473/593 |
| 6,422,960 | B1 | * | 7/2002 | Touhey et al. | 473/593 |
| 6,450,906 | B1 | * | 9/2002 | Touhey et al. | 473/593 |

FOREIGN PATENT DOCUMENTS

| | | |
|---|---|---|
| GB | 2 353 864 | 3/2001 |

* cited by examiner

*Primary Examiner*—Steven Wong

(57) ABSTRACT

An inflatable sport ball, such as a basketball, a football, a soccer ball, a volleyball or a playground ball, is provided with a self-contained inflation mechanism, or multiple self-contained inflation mechanisms, for inflating or more likely adding pressure to the ball. The pump additionally contains an integral pressure relief device to release air and relieve the pressure of the ball and/or a pressure-indicating device to determine the relative pressure of the ball. The mechanism is a pump which is inside of the ball and which is operable from outside of the ball to pump ambient air into the ball.

20 Claims, 9 Drawing Sheets

SPORT BALL WITH PUMP HAVING PRESSURE RELIEF AND/OR PRESSURE INDICATION CAPABILITY

CROSS REFERENCE TO RELATED APPLICATIONS

This application is a continuation-in-part of U.S. patent application Ser. No. 10/183,337, filed Jun. 25, 2002 now U.S. Pat. No. 6702,699, which is a continuation of U.S. patent application Ser. No. 09/594,980, filed Jun. 15, 2000, now U.S. Pat. No. 6,409,618, which is a continuation-in-part of U.S. patent application Ser. No. 09/478,225, filed Jan. 6, 2000, now U.S. Pat. No. 6,287,225, which claims the benefit of U.S. Provisional Application No. 60/159,311, filed Oct. 14, 1999. This application also claims the benefit of U.S. Provisional Application No. 60/435,225, filed Dec. 20, 2002, and U.S. Provisional Application No. 60/404,889, filed Aug. 21, 2002.

BACKGROUND OF THE INVENTION

The present invention relates to sport balls that contain mechanisms for inflating or adding pressure to the balls. The inflation mechanisms additionally have integral pressure relief capability and/or integral pressure indication capability.

Conventional inflatable sport balls, such as basketballs, footballs, soccer balls, volleyballs and playground balls, are inflated through a traditional inflation valve using a separate inflation needle that is inserted into and through a self-sealing inflation valve. A separate pump, such as a traditional bicycle pump, is connected to the inflation needle and the ball is inflated using the pump. The inflation needle is then withdrawn from the inflation valve that self-seals to maintain the pressure. This system works fine until the sport ball needs inflation or a pressure increase and a needle and/or pump are not readily available.

In conventional sport balls, there is no easy way to relieve the pressure of the ball. A separate pressure relief device or valve may be used to relieve the pressure, or the pressure may be relieved by inserting a conventional needle into the traditional needle valve to relieve the pressure. There is also no easy way to determine the pressure of the ball. Some separate or external inflation pumps, such as bicycle style pumps, have a pressure indicator on them. Alternatively, a separate pressure-indicating device may be used to determine the pressure. Surface pressure indicating devices are also well known. For sport balls comprising self-contained pump mechanisms, it would be beneficial if the pump mechanism also had the capability to relieve the pressure of the ball and/or indicate the pressure of the ball as desired.

SUMMARY OF THE INVENTION

The present invention provides a sport ball that has an integral, self-contained inflation mechanism or multiple self-contained inflation mechanisms for adding air to the ball, and the inflation mechanisms have integral pressure relief devices. The object of the invention is to be able to inflate or add pressure to a sport ball and to be able to reduce or relieve the pressure without the need for separate inflation or pressure relief equipment, such as a separate inflation needle and pump. Specifically, the invention relates to a sport ball that has at least one self-contained pump device which is operable from outside the ball and which pumps ambient air into the ball to achieve the desired pressure. The pump also comprises means on the pump for selectively reducing or relieving the pressure of the ball.

The present invention also provides a sport ball that has a self-contained inflation mechanism or multiple self-contained inflation mechanisms, and the inflation mechanisms have integral pressure indicating devices.

The present invention also provides a sport ball that has a self-contained inflation mechanism or multiple self-contained inflation mechanisms, and the inflation mechanisms have integral pressure indicating devices and means on the pump for selectively reducing or relieving the pressure of the ball.

Since the pressure in a sport ball can be too high through overinflation or a temperature increase, or too low through underinflation, air loss or a temperature decrease (as described by the Ideal Gas Law, $PV=nRT$, where P is pressure (absolute), V is volume, R is the universal gas constant (8.3145 J/mol K), T is temperature (absolute) and n is the number of moles), it is an advantage to have a pressure relief mechanism, and optionally, a pressure-indicating device that is integral to the pump. If the pressure is too low, additional air may be added using the self-contained pump of the invention. If the pressure is too high, the pressure may be relieved by bleeding pressure from the ball with the pressure relief mechanism built into the pump that will open the valve to release air from the ball. Once the pressure has been relieved, the pressure-indicating device, if present, may then be used to determine if the ball is correctly inflated. If too much air is removed, additional air may be added using the pump.

Other objects of the invention will become apparent from the specification, drawings and claims.

BRIEF DESCRIPTION OF THE DRAWINGS

In FIG. 1A, the piston is pushed down or in the locked position for use of the ball. In FIG. 1B, the piston is pulled up for adding air to the ball. In FIG. 1C, the piston is pushed further into the cylinder and the one way valve is opened by the pressure relief device to allow air to escape from the ball.

In FIG. 9A, the piston is pushed into the cylinder and the one way valve is opened to allow air to escape from the ball and into the cylinder and piston so that the pressure indicating device can display relative ball pressure. In FIG. 9B, the piston is in the locked position for use of the ball.

DESCRIPTION OF THE PREFERRED EMBODIMENTS

Figure 1A:
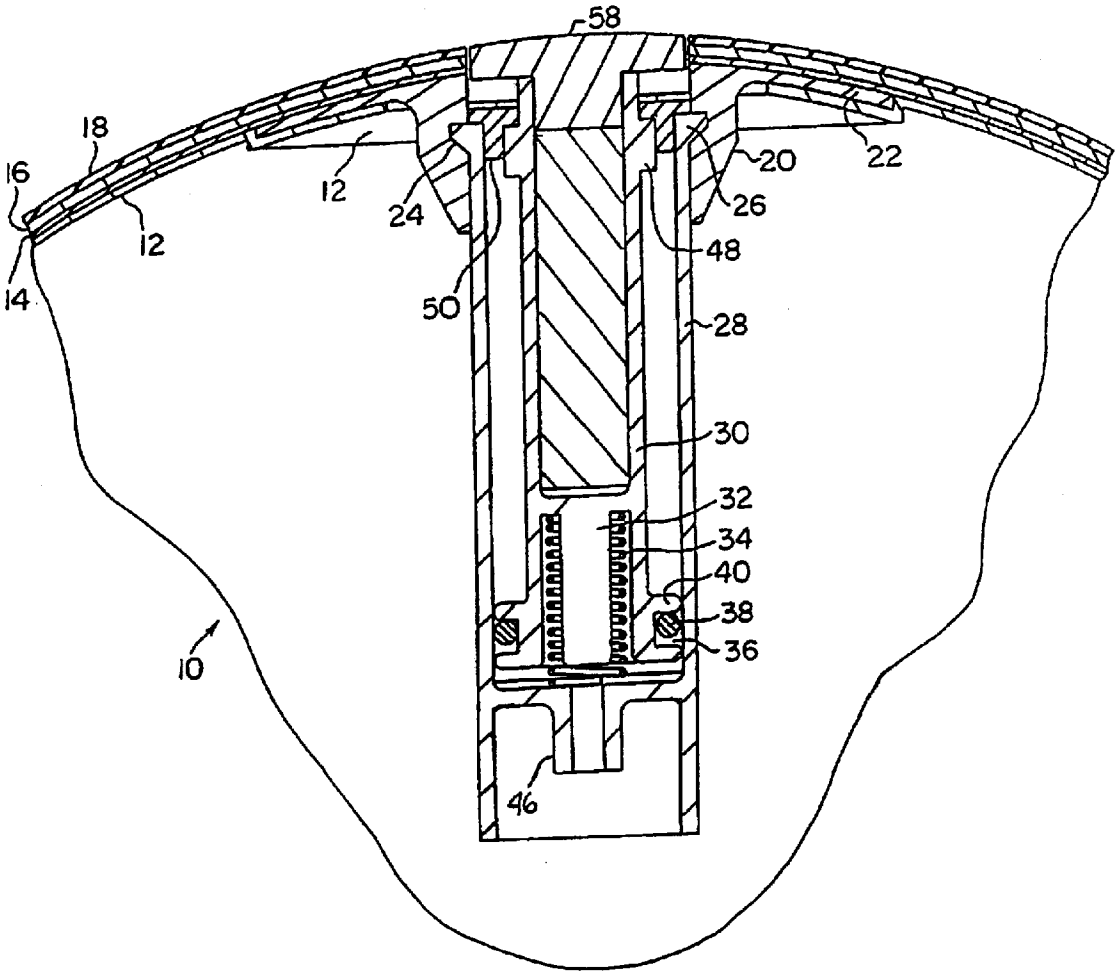
FIGS. 1A, 1B and 1C show a cross section of a portion of a sport ball with a self-contained piston and cylinder arrangement with an integral pressure relief device.

Referring to FIGS. 1 to 6 of the drawings, a portion of a sport ball 10 is illustrated incorporating an inflation pump of the invention. The ball that is illustrated is one embodiment of a typical basketball construction comprising a carcass having a rubber bladder 12 for air retention, a layer 14 composed of layers of nylon and/or polyester yarn windings wrapped around the bladder and an outer rubber layer 16. For a laminated ball, there is an additional outer layer 18 of leather or a synthetic material comprising panels that are applied by adhesive and set by cold molding. The windings are randomly oriented and two or three layers thick, and they form a layer that cannot be extended to any significant degree and that also restricts the ball from expanding to any significant extent above its regulation size when inflated above its normal playing pressure. This layer for footballs, volleyballs and soccer balls is referred to as a lining layer and is usually composed of cotton or polyester cloth that is impregnated with a flexible binder resin such as vinyl or latex rubber. The outer layer may be stitched for some sport balls, such as a soccer ball or a volleyball. The outer layer may optionally have a foam layer backing 16 or a separate foam layer between the lining layer and outer layer.

Other sport ball constructions, such as sport balls produced by a molding process, such as blow molding, may also be used in the invention. For an example of a process for molding sport balls, see, for example, U.S. Pat. No. 6,261,400, incorporated herein by reference.

Materials suitable for use as the bladder and/or carcass include, but are not limited to, butyl, SBR, latex, urethane, and other rubber materials generally known in the art. Examples of materials suitable for the winding layer include, but are not limited to, nylon, polyester and the like. Examples of materials suitable for use as the outer layer, or cover, include, but are not limited to, polyurethanes, including thermoplastic polyurethanes; polyvinylchloride (PVC); leather; synthetic leather; and composite leather. Materials suitable for use as the optional foam layer or foam backing include, but are not limited to, NEOPRENE™, SBR, TPE, EVA, or any foam capable of high or low energy absorption. Examples of commercially available high or low energy absorbing foams include the CONFOR™ open-celled polyurethane foams available from Aearo EAR Specialty Composites, Inc., and NEOPRENE™ (polychloroprene) foams available from Dupont Dow Elastomers.

In a preferred method of making a sport ball comprising a pump, incorporated into the carcass of the ball of the invention during the formation is the rubber pump boot or housing 20 with a central opening and with a flange 22 which is bonded to the bladder using a rubber adhesive. The boot 20 is located between the rubber bladder 12 and the layer of windings 14. The boot 20 may be constructed of any suitable material, such as butyl rubber, natural rubber, urethane rubber, or any suitable elastomer or rubber material known in the art, or combinations thereof. A molding plug (not shown) is inserted into the boot opening during the molding and winding process to maintain the proper shape of the central opening and to allow the bladder to be inflated during the manufacturing process. The molding plug is preferably aluminum, composite or rubber, most preferably aluminum. The central opening through the boot 20 is configured with a groove 24 to hold the flange 26 on the upper end of the pump cylinder 28. The cylinder can optionally be bonded to the boot using any suitable flexible adhesive (epoxy, urethane, cyanoacrylate, or any other flexible adhesive known in the art). The pump cylinder shown is a right cylinder, but other cylinders that are not right cylinders, such as a cylinder having a non-circular cross-section, may be used.

Figure 1B:
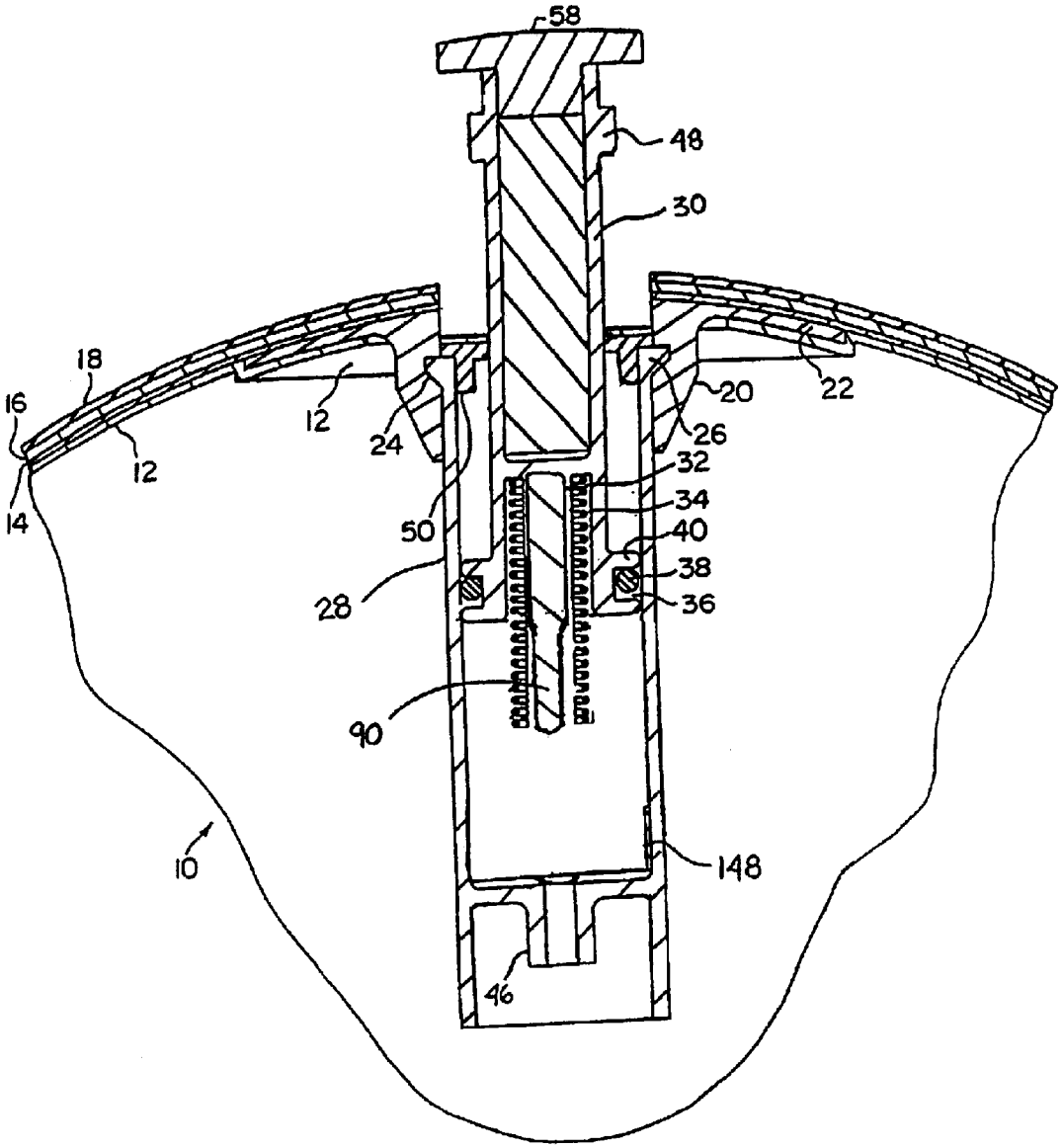
Figure 1C:
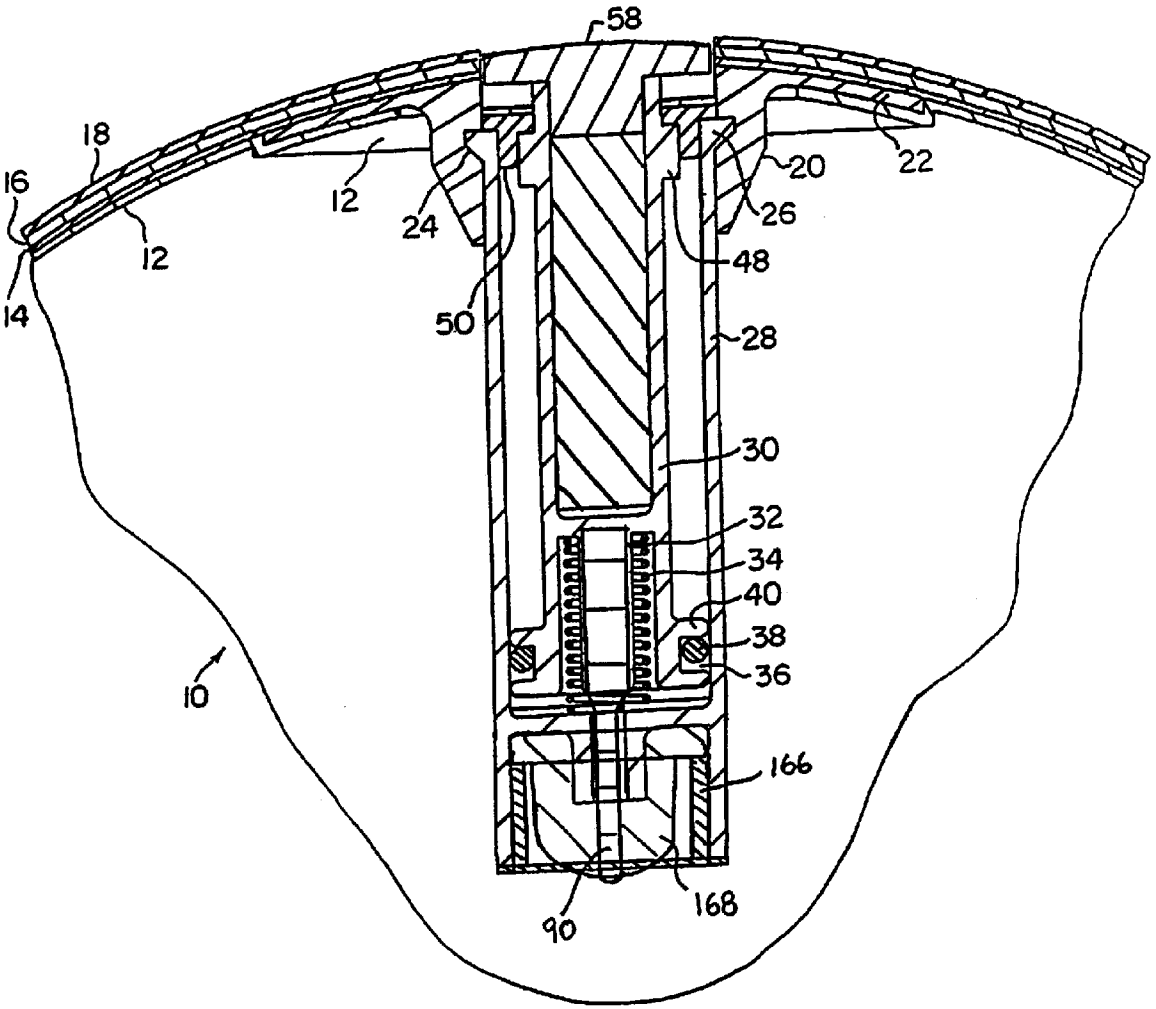

Located in the pump cylinder 28 is the pump piston 30 that is illustrated in FIGS. 1A, 1B and 1C. In one preferred embodiment, the piston 30 includes a circular groove or hollowed out portion 32 at the bottom end that contains the spring 34 that forces the piston 30 up in the cylinder 28. In another preferred embodiment of the pump, the spring is not necessary to force the piston up in the cylinder. In FIG. 1A, the pump is in the locked position and the ball is ready for use. In FIG. 1B, the pump is in the unlocked position and is ready to be activated or pumped to add air to the ball.

Attached to the upper end of the piston 30 is a button or cap 58 that is designed to essentially completely fill the hole in the carcass. In some embodiments, such as a basketball or football, the button or cap 58 is preferably flush or essentially flush with the surface of the ball. In other embodiments, such as a soccer ball, the button or cap 58 is preferably below the surface when the pump is locked. In some embodiments, the button 58 may have an O-ring 138 molded onto the bottom of it. This button 58 may be of any desired material. Examples of materials suitable for use as the button 58 include urethane rubber, butyl rubber, natural rubber or any other material known in the art. A preferred rubber for use as the button or cap is a thermoplastic vulcanizate such as SANTOPRENE™ rubber, available from Advanced Elastomer Systems, Akron Ohio. If desired, the button can be molded to match the feel of the rest of the ball. For example, its surface may be textured to increase grip if desired, such as for a basketball. For a soccer ball, the surface may be smooth. If the top of the pump (button) is below the surface of the ball when not in use, there is little or no need for the texture of the button to match the feel of the ball. Texture may be necessary to make it easier to utilize the pump.

Figure 3A:
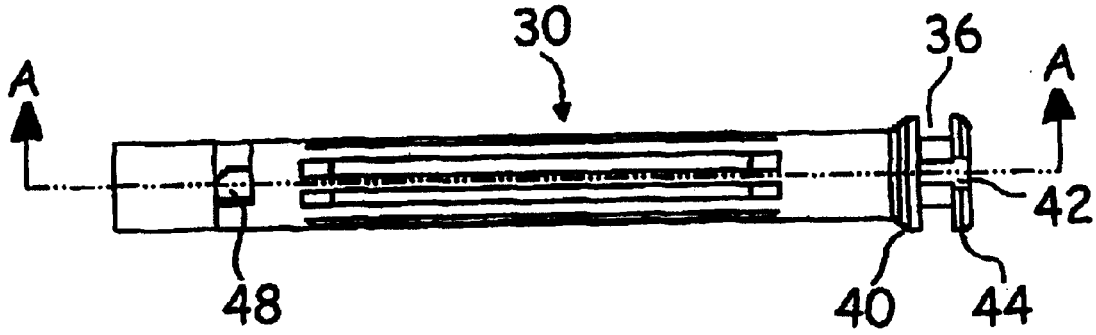
FIG. 3A is a side view of the piston shown in FIGS. 1A, 1B and 1C.
Figure 3B:
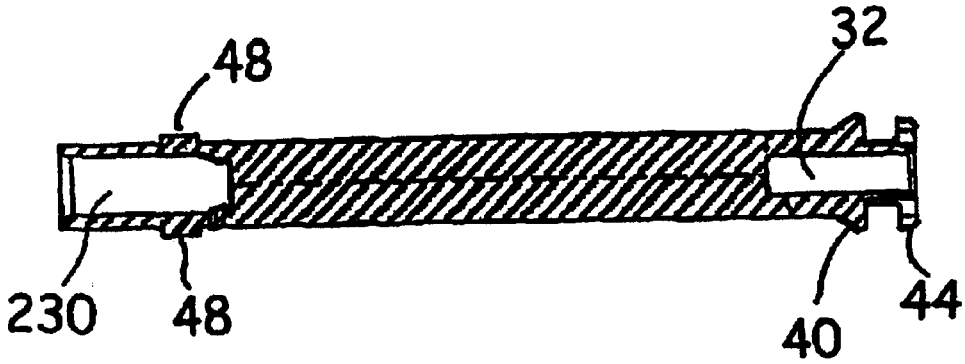
FIG. 3B is a cross section view of the piston taken at line A—A.

At the bottom end of the piston 30 is an O-ring groove 36 containing the O-ring 38. As seen in FIG. 1, this O-ring groove 36 is dimensioned such that the O-ring 38 can move up and down in the groove 36. The O-ring is forced into the position shown in FIG. 1 when the piston 30 is pushed down. In this position, the O-ring seals between the cylinder wall and the upper flange 40 of the groove 36. As shown in FIG. 3A, there are recesses or slots 42 in the groove 36 extending from just below the upper flange 40 down through the lower flange 44. Only one of these slots 42 is shown in FIG. 3A but there are preferably two or more. When the piston 30 is forced up by the spring 34, the O-ring 38 moves to the bottom of the groove 36 which opens up a by-pass around the O-ring through the recesses 42 so that the air can enter the cylinder 28 below the piston 30. Then, when the piston is pushed down, the O-ring moves back up to the top of the groove and seals to force the air out through the cylinder exit nozzle 46.

Figure 4A:
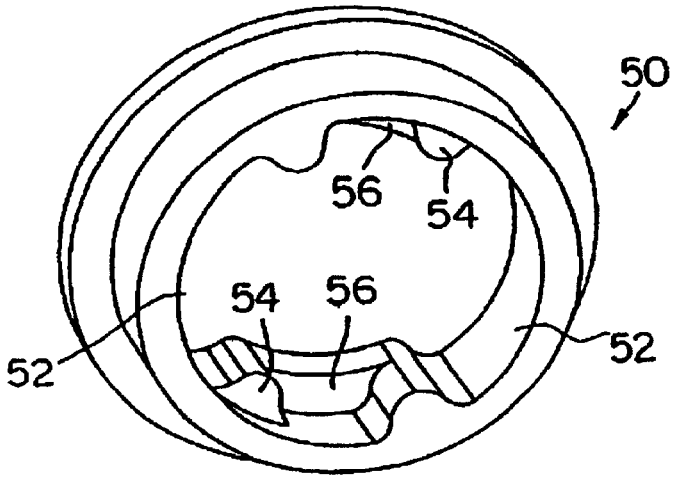
FIG. 4A is an isometric view of the cylinder cap for the pump of FIGS. 1A, 1B and 1C showing the configuration for locking and unlocking the pump piston.

At the upper end of the piston 30 are the two flanges 48 that cooperate with the cylinder cap 50 to hold the piston down in the cylinder and to release the piston for pumping. The cylinder cap 50 is fixed into the top of the cylinder 28 and the piston 30 extends through the center of the cylinder cap 50. The cap 50 is cemented into the cylinder using a suitable adhesive, such as a UV cured adhesive. FIG. 4A shows an isometric view of the bottom of the cylinder cap 50 and illustrates the open areas 52 on opposite sides of the central opening through which the two flanges 48 on the piston 30 can pass in the unlocked position. In the locked position, the piston 30 is pushed down and rotated such that the two flanges 48 pass under the projections 54 and are rotated into the locking recesses 56.

In a preferred embodiment, fibers or other reinforcing materials may be incorporated into the rubber compound or thermoplastic material during mixing. Examples of fiber materials suitable for use include, but are not limited to, polyester, polyamide, polypropylene, KEVLAR®, cellulistic, glass and combinations thereof. Incorporation of fibers or other reinforcing materials into the button or cap 58 improves the durability of the button and improves the union of the button or cap 58 and the piston rod 30 or connecting piece 130, thus preventing the button or cap 58 from shearing off during use. Although the pump would still function without the button 58, it becomes very difficult to use.

Preferably, the button or cap 58 is co-injected with the piston 30 as one part. Alternatively, the button or cap 58 may be co-injected with a connecting piece 130, and the button or cap 58 and connecting piece 130 may then be attached to the upper end of the piston 30 using an adhesive suitable for bonding the two pieces together. The button 58 and connecting piece 130 are mounted in the piston in a hollow groove 230 that is dimensioned to fit the connecting piece 130. Co-injecting the button 58 and the piston 30 as one part, or alternatively, the button 58 and the connecting piece 130 as one part that is mounted to the piston, provides a more durable part that is less likely to break or come apart during routine use of the ball. The button or cap material and the piston material need to be selected such that the two materials will adhere when co-injected. Testing of various combinations has shown that co-injecting or extruding a soft rubber button, such as a button comprising SANTOPRENE™, and a harder piston, such as polycarbonate or polypropylene and the like, provides a durable bond without the need for adhesives.

The piston and the connecting piece may be formed of any suitable material, such as, but not limited to, polycarbonate (PC), polystyrene (PS), acrylic (PMMA), acrylonitrile-styrene acrylate (ASA), polyethylene terephthalate (PET), acrylonitrile-butadiene styrene (ABS) copolymer, ABS/PC blends, polypropylene (preferably high impact polypropylene), polyphenylene oxide, nylon, combinations thereof, or any suitable material known in the art. Materials with high impact strength are preferred. The material used for the piston is preferably clear or transparent if an optional pressure-indicating device is used. This will allow the pressure-indicating device to be viewed by the user.

Figure 8:
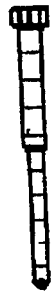
FIG. 8 shows a side view of one preferred embodiment of a pressure relief device (needle) for use in the present invention.

In FIG. 1C, the pump is in the pressure relief position. The piston 30 includes a needle or other suitable device 90 that will force the valve 168 open to allow air to escape. The needle is not shown in FIGS. 1A and 1B. FIG. 8 shows a side view of one preferred embodiment of a needle 90 for use in the present invention. Any shape needle 90 may be used as long as it fits in the pump and one-way valve and performs the desired function of opening the valve when desired.

The needle 90 is attached to or mounted on the piston in any suitable manner known in the art. In the embodiment shown, the piston 30 is hollowed out or has an opening 32 to receive the needle 90. Preferably, the piston is molded using a core pin in the end (not shown), and the core pin is then removed to allow the needle and spring to be inserted into the piston. The needle 90 is then mounted in or on the piston using a suitable method, such as with an adhesive. The spring, if included, is preferably mounted around the needle 90. To relieve the pressure, the pump can be in either the locked or unlocked position, as long as the flanges are lined up such that the piston can be pushed into the cylinder allowing the needle to open the one-way valve. The button 58 is then pushed into the cylinder, and this pushes the needle 90 into the valve 68 or 168, thereby opening it to allow air to escape. If the pump is in the locked position, the button 58 is pushed further into the cylinder than it already is in the locked position.

The needle 90 can be constructed of any suitable material, such as, but not limited to, polycarbonate (PC), polystyrene (PS), acrylic (PMMA), acrylonitrile-styrene acrylate (ASA), polyethylene terephthalate (PET), acrylonitrile-butadiene styrene (ABS) copolymer, ABS/PC blends, polypropylene (preferably high impact polypropylene), polyphenylene oxide, nylon, combinations thereof, or any suitable material known in the art. Materials with high impact strength are preferred so that the needle is not damaged during routine use. Alternatively, the piston and needle may be formed as one piece or in one operation of the same or different materials.

Figure 9A:
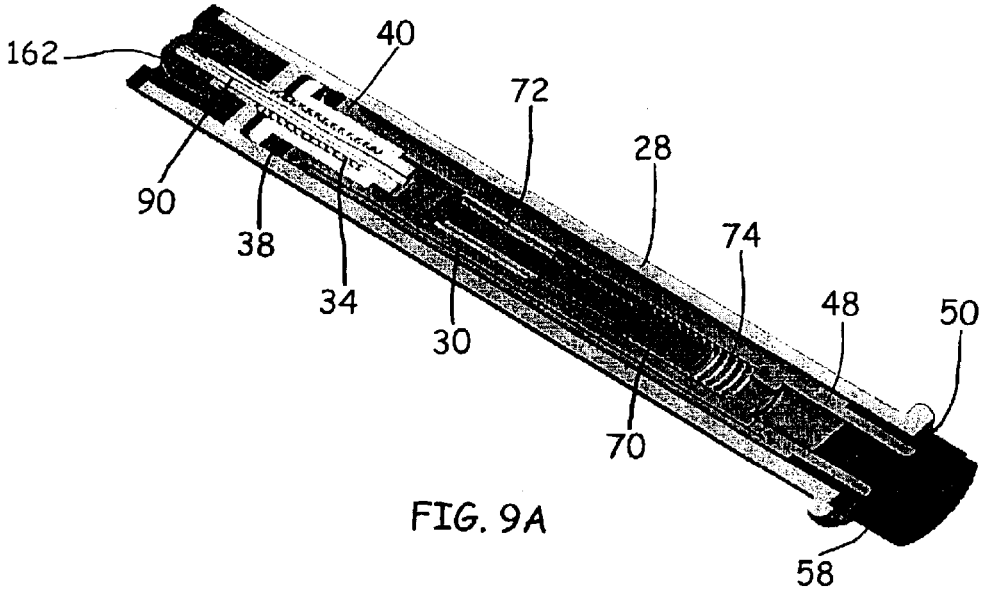
FIGS. 9A and 9B show a cross-section view of a pump having a pressure indicating device and pressure relief capability for use in the invention.
Figure 9B:
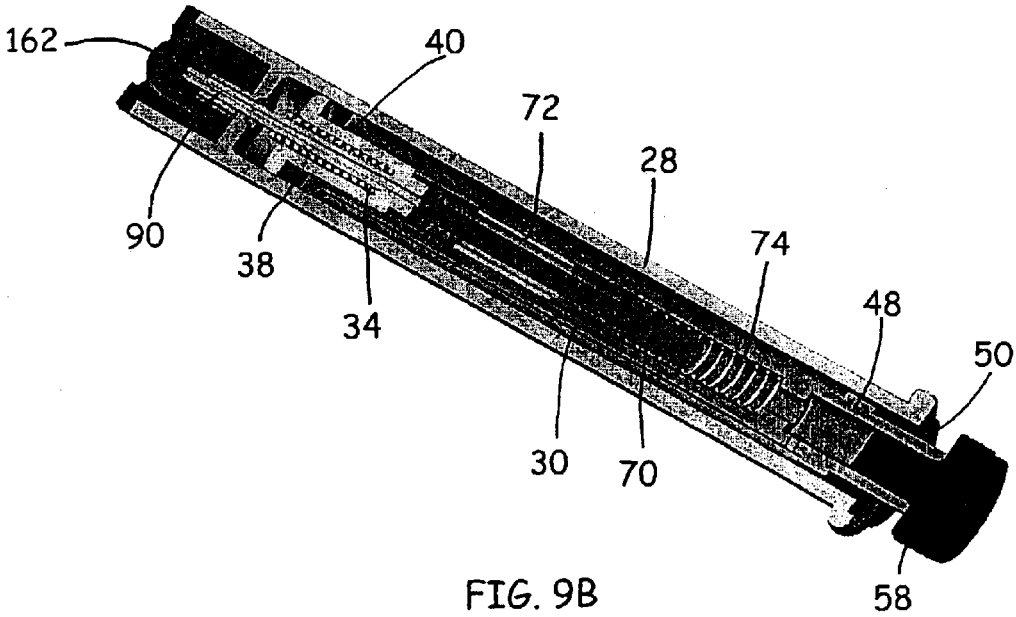

In another embodiment of the invention, the pump may comprise a pressure indicating device built into the pump, such as in the pump stem. In one preferred embodiment, the piston is hollowed out to allow a pressure indicating device to be positioned inside. As shown in FIGS. 9A, 9B and 9C, piston 30 is hollowed out, and a smaller piston 70 and spring 74 are placed inside. Spring 74 is a calibrated gauge spring. Around part of the piston 70 is a slide indicator 72. In the resting or home position, the slide indicator 72 rests against the bottom of the piston 70. The slide indicator 72 and the piston 30 have markings to indicate the relative pressure of the ball. The markings can be actual pressure values and/or relative pressures, such as low, acceptable, or high, different colors, or similar markings, as desired.

FIG. 9A shows the pump in the position to check the pressure. The needle 90 is opening the one way valve 162, allowing air to enter the pump cylinder 28 and piston 30. The piston 70 moves according to the pressure against the calibrated spring 74. The piston 70 moves the slide 72 as the piston 70 moves against the spring 74. To check the pressure, the button 58 is unlocked and then is quickly depressed and released. The piston 30 is then pulled out and the pressure can be read.

FIG. 9B shows the pump in the locked position, when the ball is ready for use. The slide 72 remains in place until the piston is shaken. The slide can return to its home position until the next pressure measurement, when the air pressure will move it to indicate the relative pressure of the ball.

In another embodiment of the invention, the pump comprises a means for relieving the pressure of the ball and a pressure indicating device in the pump stem. As previously described, FIGS. 9A and 9B show a pump having both pressure relief and pressure indication.

Figure 4B:
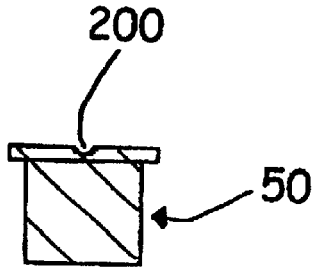
FIG. 4B is a side view of the cap for the pump.
Figure 4C:
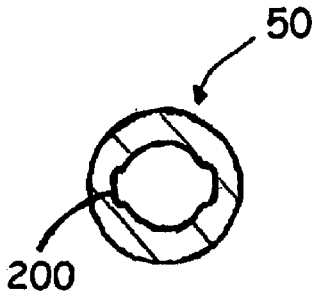
FIG. 4C is a top view of the cap.

The cylinder 28 also has at least one projection 148 on the inside of the cylinder near the bottom of the cylinder. The projection is a slight raised area on the wall of the cylinder. When the pump is being used to relieve air pressure, this projection on the cylinder acts to deflect the O-ring 38 and break the seal between the O-ring 38 and the wall of the cylinder 28. This allows air to pass out of the ball into the cylinder when the pressure is being intentionally relieved. As shown in FIGS. 4B and 4C, the cylinder cap 50 also has a relief groove 200. The relief groove allows air to escape the cylinder into the atmosphere, thus reducing the pressure of the ball.

In some embodiments of the invention, such as the soccer ball, volleyball and football, there is an O-ring 138 molded on the bottom of the button 58. The cylinder cap 50 is also extended in length. This O-ring 138 creates a seal between the button and the extended cylinder cap 50 that acts to keep dust, dirt, and the like, out of the pump. This is important with sport balls that may be played in dirty conditions. On the inside of the cylinder cap 50 there is at least one projection (similar to projection 148) on the inside of the cylinder (not shown). This projection acts to deflect the O-ring 138 molded on the bottom of the button or cap 58. For this button and cylinder cap configuration, the projection in the cylinder cap 50 is necessary because of the O-ring 138 on the button 58.

Figure 7:
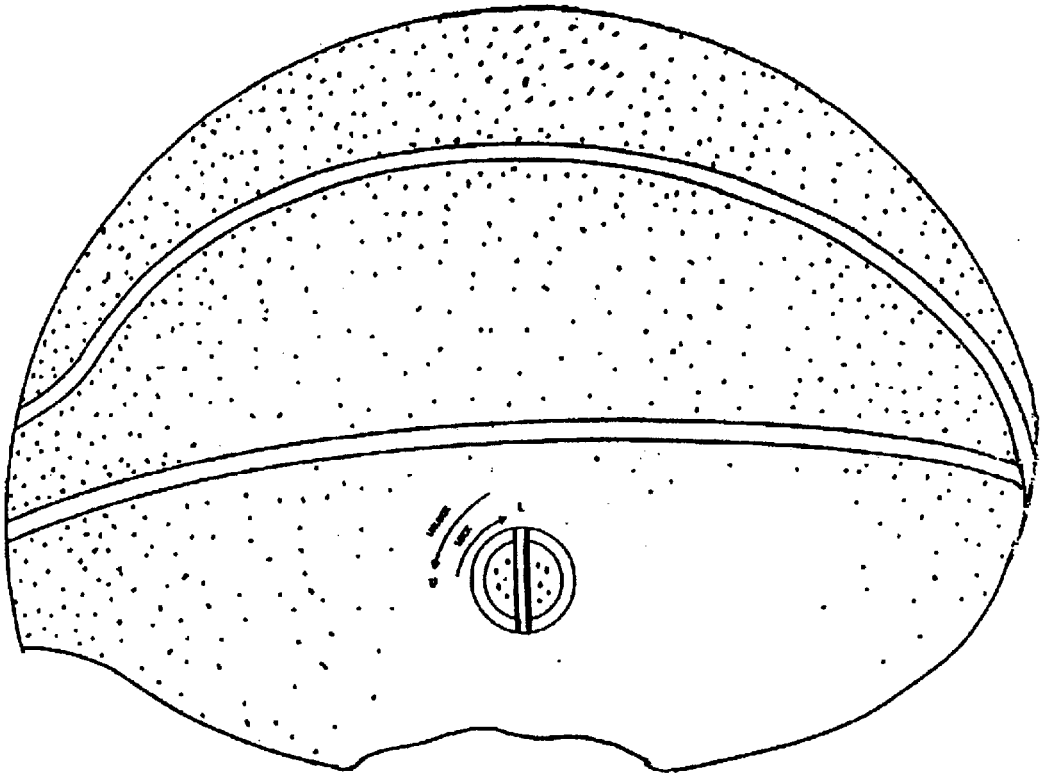
FIG. 7 is a top view of a portion of a sport ball illustrating the markings or graphics on the ball showing the pump in the locked and unlocked positions and the button or cap in the proper locked position.
Figure 2:
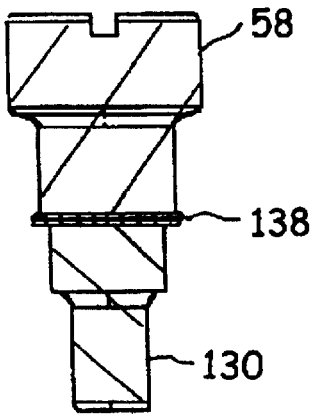
FIG. 2 is a side view of one embodiment of the button and stem for the pump.

The ball may have markings or graphics to illustrate the proper locked position of the pump. To prevent the piston from extending inadvertently, it is important that the pump is properly locked using the locking tabs, as previously described. FIG. 7 shows an example of such graphics on a portion of a basketball, showing the button 58 in a locked position. The graphics indicate the direction that the button is turned to unlock or release the pump, as well as the direction to turn the button to return it to a locked position. The ball may also have graphics (not shown) indicating that the pressure is released by pushing down on the button, if desired.

Figure 5A:
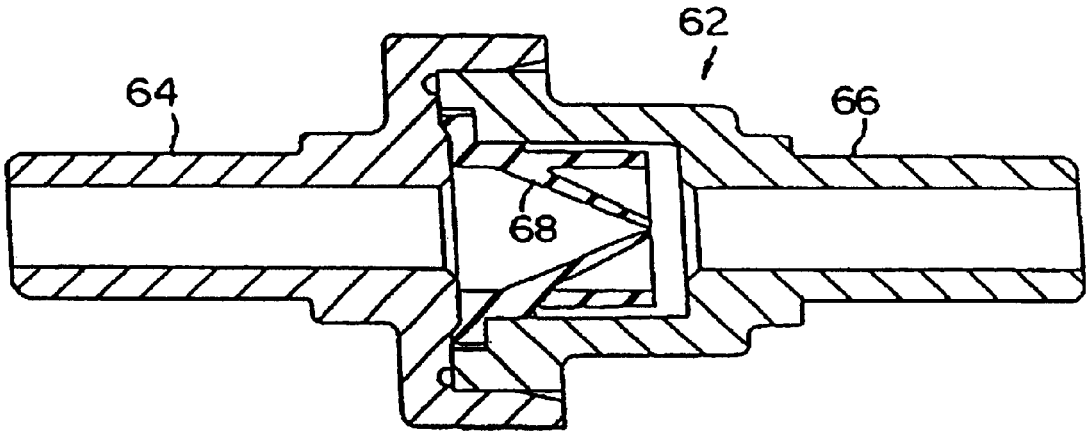
FIGS. 5A and 5B are detailed cross-section views of two embodiments of one-way valve assemblies for use on the exit of the pump of FIGS. 1A, 1B and 1C.
Figure 5B:
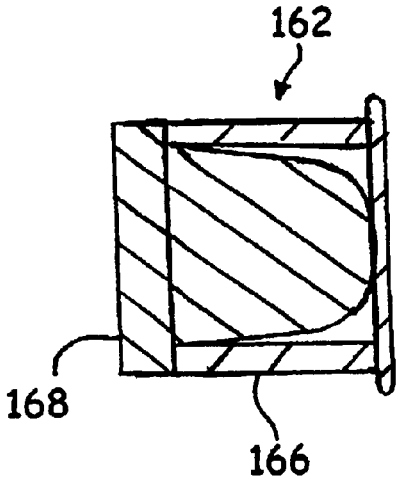

FIGS. 1A and 1B of the drawings show a pump exit nozzle 46 but do not show the one-way valve that is attached to this exit. FIG. 1C shows the pump exit nozzle 46 and one type of one-way valve 168. Shown in FIG. 5A is one preferred embodiment of a one-way valve assembly 62 of the duckbill-type to be mounted in the exit nozzle 46. This assembly comprises an inlet end piece 64, an outlet end piece 66 and an elastomeric duckbill valve 68 captured between the two end pieces. Shown in FIG. 5B is another preferred embodiment of a one-way valve assembly 162 to be mounted in the exit nozzle 46. This assembly comprises an outlet piece 166 and an elastomeric valve 168 mounted in the end piece 166. The end piece 166 is then mounted in the end of the cylinder 28 using any method known in the art, such as ultrasonic welding, an adhesive, and the like. This one-way valve 168 is similar to a traditional needle type valve. The end pieces 64, 66 and 166 are preferably plastic, such as a polycarbonate, polypropylene, nylon, polyethylene, or combinations thereof, but may be any material suitable for use. The end pieces 64 and 66 may be ultrasonically welded together. Any type of one-way valve or other valve known in the art may be used, as long as it prevents air from flowing out of the interior of the ball when not desired.

Figure 6:
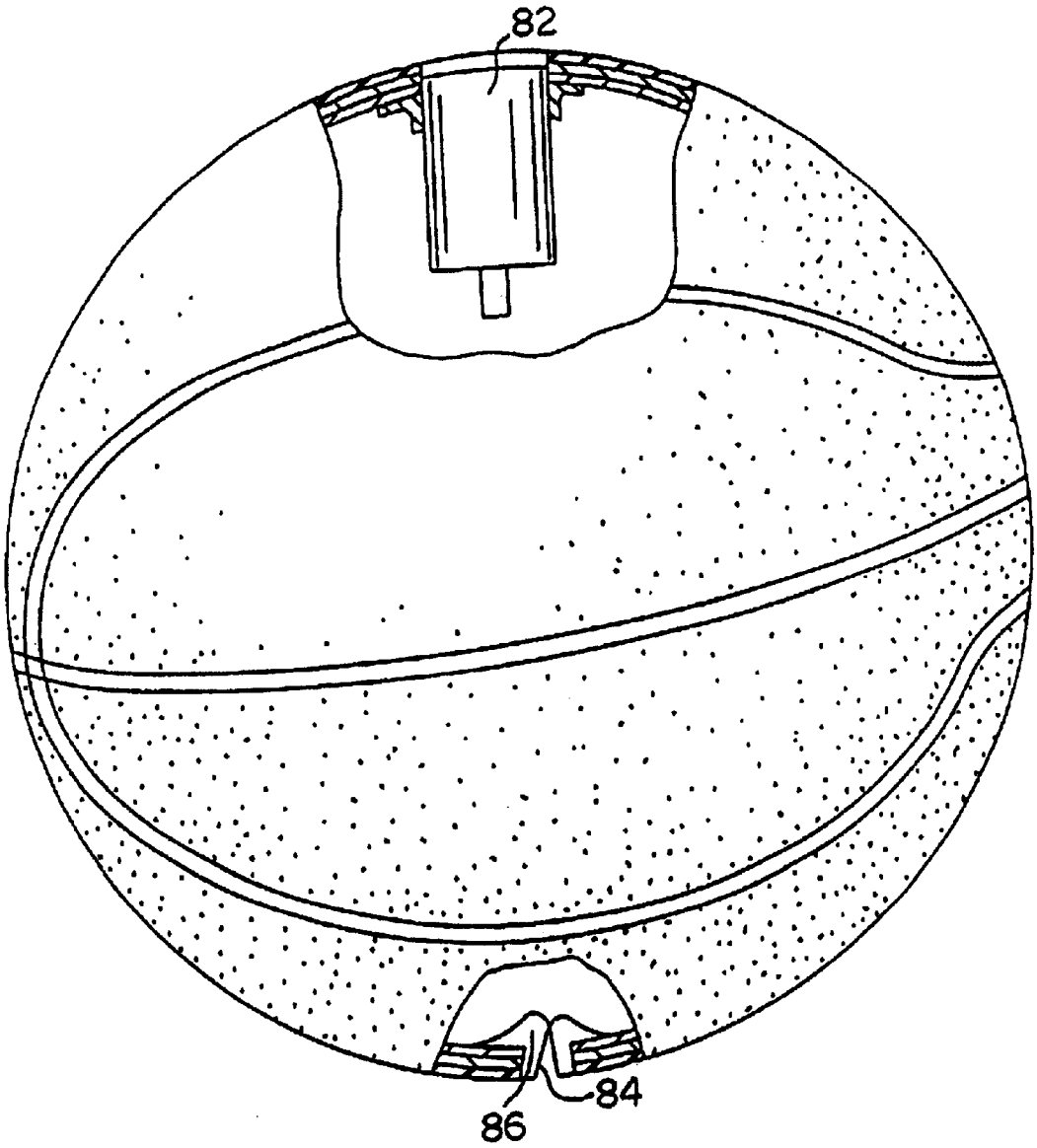
FIG. 6 is a cross-section view of an entire sport ball illustrating a pump on one side and a traditional inflation valve on the opposite side including a counterweight.

A pump assembly of the type described and illustrated in the Figures is preferably made primarily from plastics such as polystyrene, polyethylene, nylon, polycarbonate and combinations thereof, but it can be made of any appropriate material known in the art. Although the assembly is small and light weight, perhaps only about 5 to about 25 grams, a weight may optionally be added to the ball structure to counterbalance the weight of the pump mechanism. In lighter weight or smaller balls, such as a soccer ball, the pump assembly may weigh less and/or be smaller (shorter) than a corresponding pump assembly for a heavier ball, such as a basketball. FIG. 6 illustrates such a counterbalance arrangement wherein a pump mechanism generally designated 82 is on one side of the ball and a standard needle valve 84 is oh the opposite side of the ball. In this case, the material 86 forming the needle valve 84 is weighted. Additional material can be added to the needle valve housing or the region surrounding the valve. Alternatively, a dense metal powder such as tungsten could be added to the rubber compound.

The description thus far and the drawing FIGS. 1 to 8 disclose particular and preferred pump arrangements. However, other pump arrangements can be used within the scope of the invention. Examples of other pump arrangements that may be used with the invention are shown in patents owned by the assignee of the present invention, and include: U.S. Pat. Nos. 6,287,225; 6,422,960; 6,450,926; and 6,409,618, incorporated herein by reference.

The foregoing description is, at present, considered to be the preferred embodiments of the present invention. However, it is contemplated that various changes and modifications apparent to those skilled in the art may be made without departing from the present invention. Therefore, the foregoing description is intended to cover all such changes and modifications encompassed within the spirit and scope of the present invention, including all equivalent aspects.

What is claimed is:

1. An inflatable sport ball comprising an internal pump, wherein the pump includes means for actuating the pump and wherein said pump includes means for pumping ambient air into the interior of the ball and means for releasing air from the interior of the ball, and further wherein the pump is essentially flush with or below the surface of the ball when not in use.

2. The inflatable sport ball of claim 1, wherein the pump comprises a one-way valve that prevents air flow from the interior of the ball.

3. The inflatable sport ball of claim 2, wherein the means for releasing air from the ball comprises opening the one-way valve and allowing air flow from the interior of the ball.

4. The inflatable sport ball of claim 1, wherein the sport ball is selected from the group consisting of basketballs, soccer balls, volleyballs, footballs and playground balls.

5. The inflatable sport ball of claim 1, further comprising means for determining the relative pressure of the sport ball.

6. The inflatable sport ball of claim 1, further comprising means to counterbalance the weight of the internal pump.

7. The inflatable sport ball of claim 3, further comprising means for determining the relative pressure of the sport ball.

8. The inflatable sport ball of claim 7, wherein the pressure indicating device is in the piston.

9. An inflatable sport ball comprising an internal pump, wherein the pump includes means for actuating the pump and wherein said pump includes means for pumping ambient air into the interior of the ball, further wherein the pump includes means for indicating the relative pressure of the ball, and further wherein the pump is essentially flush with or below the surface of the ball when not in use.

10. The inflatable sport ball of claim 9, wherein the pump comprises a one-way valve that prevents air flow from the interior of the ball.

11. The inflatable sport ball of claim 10, wherein the pump further comprises means for releasing air from the interior of the ball.

12. The inflatable sport ball of claim 11, wherein the means for releasing air from the ball comprises opening the one-way valve and allowing air flow from the interior of the ball.

13. The inflatable sport ball of claim 9, wherein the sport ball is selected from the group consisting of basketballs, soccer balls, volleyballs, footballs and playground balls.

14. The inflatable sport ball of claim 11, wherein the sport ball is selected from the group consisting of basketballs, soccer balls, volleyballs, footballs and playground balls.

15. The inflatable sport ball of claim 9, further comprising means to counterbalance the weight of the internal pump.

16. An inflatable sport ball comprising an internal pump, wherein the pump includes means for actuating the pump and wherein said pump includes means for pumping ambient air into the interior of the ball and means for releasing air from the interior of the ball, and wherein the pump includes means for indicating the relative pressure of the ball, further wherein the pump is essentially flush with or below the surface of the ball when not in use.

17. The inflatable sport ball of claim 16, wherein the pump comprises a one-way valve that prevents air flow from the interior of the ball.

18. The inflatable sport ball of claim 17, wherein the means for releasing air from the ball comprises opening the one-way valve and allowing air flow from the interior of the ball.

19. The inflatable sport ball of claim 16, wherein the sport ball is selected from the group consisting of basketballs, soccer balls, volleyballs, footballs and playground balls.

20. The inflatable sport ball of claim 16, further comprising means to counterbalance the weight of the internal pump.

* * * * *